United States Patent [19]

Chisholm

[11] Patent Number: 4,640,540

[45] Date of Patent: Feb. 3, 1987

[54] GUTTER CLEANING TOOL

[76] Inventor: Bruce Chisholm, 4141 S. Marigold, Portland, Oreg. 97219

[21] Appl. No.: 800,685

[22] Filed: Nov. 22, 1985

[51] Int. Cl.[4] ..... A47F 13/08; E04D 13/06

[52] U.S. Cl. ..... 294/55; 15/236 R

[58] Field of Search ..... 294/1.1, 1.3, 7, 19.1, 294/49, 55; 5/104.03, 104.05, 104.16–104.19, 105, 160, 242, 245; 141/108, 109; 209/418, 419

[56] References Cited

U.S. PATENT DOCUMENTS

| | | | |
|---|---|---|---|
| 2,299,418 | 10/1942 | Thomas | 294/55 |
| 2,618,501 | 11/1952 | Tallant | 294/55 |
| 2,666,309 | 1/1954 | Anderson et al. | 294/55 X |
| 3,002,209 | 10/1961 | McKinstry | 15/245 X |
| 4,447,927 | 5/1984 | Malless | 15/236 R |

FOREIGN PATENT DOCUMENTS

| | | | |
|---|---|---|---|
| 2437467 | 5/1980 | France | 15/236 R |
| 2499841 | 8/1982 | France | 294/55 |
| 1559925 | 1/1980 | United Kingdom | 15/236 R |

*Primary Examiner*—Johnny D. Cherry

*Attorney, Agent, or Firm*—Chernoff, Vilhauer, McClung & Stenzel

[57] ABSTRACT

The tool of the present invention is comprised of a scoop having flexible side walls which, at the mouth of the scoop, normally are wider and higher than the gutter into which the tool is to be inserted. The side walls become progressively narrower extending away from the mouth of the scoop and terminate in a heel at the closed end of the scoop which is considerably narrower than its mouth. In addition, the heel is relatively inflexible thereby allowing it to be inserted into a gutter which is much smaller than the remainder of the scoop. Once the heel is in place the remainder of the scoop can be inserted into the gutter by rotating the scoop downwardly while drawing the tool backwardly along the length of the gutter. Once in place the flexible side walls will conform to the shape of the gutter thereby completely filling the gutter. After the tool is inserted the gutter is cleaned by sliding the tool along the gutter until it is full. A handle located above and behind the heel of the scoop assists the user in inserting the tool and in moving it to clean the gutter. A low-walled tongue located at the front of the scoop, in front of the mouth, facilitates removing debris from beneath the spikes which attach the gutter to the roof.

7 Claims, 5 Drawing Figures

GUTTER CLEANING TOOL

BACKGROUND AND SUMMARY OF THE INVENTION

This invention relates to a tool for cleaning debris out of gutters and in particular to such a tool which can be inserted into smaller than normal gutters and still completely fill a normal-sized gutter.

Ever since there have been gutters on buildings, keeping them free of debris such as leaves and dirt has provided a continuous challenge. Attempts to cover gutters have proven to be ineffective and the tools provided to remove debris have not functioned satisfactorily. This is because gutters come in many sizes and shapes and the overhang of the roof often makes the opening above a gutter smaller than the gutter itself. This is particularly true when new roofing material has been applied on top of the old. If the tool is made small enough to be inserted into all sizes of gutters, it will not completely fill most gutters and thus will be ineffective at removing debris from them.

The tool of the present invention overcomes this difficulty by providing a scoop which has flexible side walls which are separated from one another at the mouth of the scoop by a distance which is greater than the width of the widest gutter the tool will be used in. The width of the scoop narrows, extending away from its mouth, to a heel which is considerably narrower than the remainder of the scoop and which is relatively inflexible. Over the majority of the length of the scoop the side walls are higher than the walls of the gutter, however, they are considerably lower at the front or open end of the scoop thereby forming a tongue which will fit under the spikes which attach the gutter to the roof.

A handle which extends upwardly and rearwardly from the heel allows the user to insert the tool into a gutter and then slide it along the gutter to remove debris from it. The narrow, relatively inflexible heel is inserted into the gutter first, by rotating the back of the handle downwardly, and, due to its size, the heel can be inserted into the smallest of gutter openings. The remainder of the scoop is then inserted in the gutter by rotating the back of the handle upwardly while drawing the heel towards the user and along the length of the gutter. Since its side walls are flexible the scoop can be pushed into the gutter this way even though it normally is much wider than the gutter, and when in place the side walls will conform to the gutter and completely fill it. Thus, the tool will completely clean the gutter when it is pushed through it.

The low-walled tongue allows the tool to be pushed partially under the spikes which attach the gutter to the roof and thereby permit cleaning the entire gutter. In addition, since the side walls of the scoop are higher than the gutter, this will facilitate the scoop's withdrawal therefrom. In addition, side walls always will remain in contact with the lips of the gutter and thus the scoop will fill the gutter even when the gutter is full of debris.

Accordingly, it is a principal object of the present invention to provide a tool for cleaning gutters which can be inserted into a relatively small opening above the gutter and still completely fill the gutter when inserted therein.

It is a further object of the present invention to provide such a tool which will completely fill gutters having a wide variety of sizes and shapes.

It is a further object of the present invention to provide such a tool which is easy to insert into a gutter.

It is a still further object of the present invention to provide such a tool which facilitates cleaning under the spikes that attach the gutter to the roof.

It is a further object of the present invention to provide such a tool which places the user's hands above the roof and the gutter thus preventing injury.

The foregoing and other objectives, features and advantages of the present invention will be more readily understood upon consideration of the following detailed description of the invention taken in conjunction with the accompanying drawings.

DETAILED DESCRIPTION OF A PREFERRED EMBODIMENT

Figure 1:
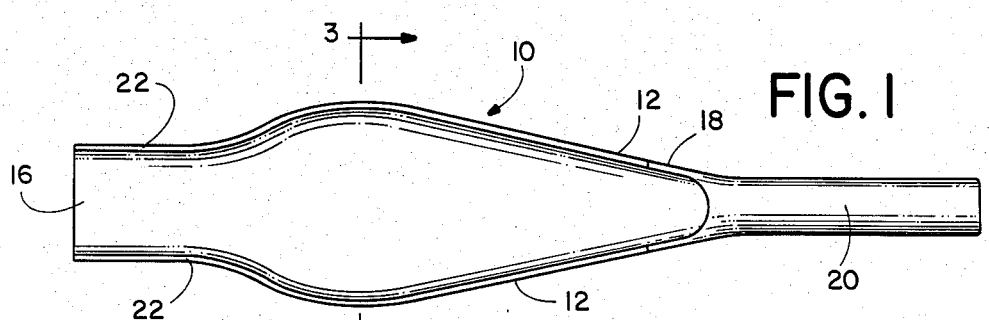
FIG. 1 is a plan view of a gutter cleaning tool embodying the present invention.
Figure 2:
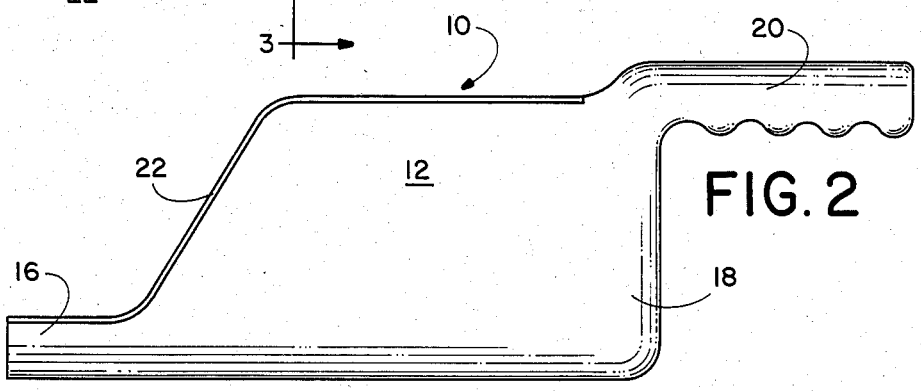
FIG. 2 is a side elevation view of the tool of FIG. 1.
Figure 3:
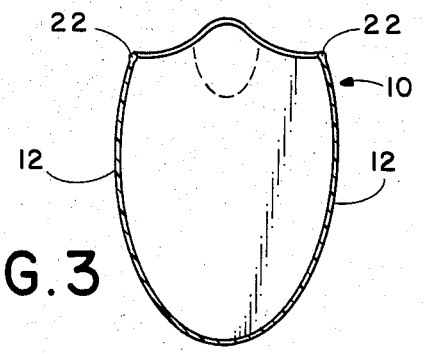
FIG. 3 is a sectional view taken along line 3—3 of FIG. 1.

Referring to FIGS. 1 and 2 of the drawings, the tool of the present invention comprises a scoop 10 having paired upstanding side walls 12 which are formed from a flexible material. In the embodiment illustrated the scoop has a U-shaped cross-section, FIG. 3, and at its widest point it is wider than the gutter 14 into which it will be inserted. In addition, the side walls are slightly higher than the height of the gutter, which causes them to remain in contact with the gutter even when it is full of debris. Preferably, the side walls 12 are made shorter at the front, or open edge of the scoop than they are over the remainder of its extent to form a low-walled tongue 16. Thus, the tongue can reach under the spikes (not shown) which attach the gutter to the building it serves in order to permit cleaning of the entire gutter.

Located at the closed end of the scoop 10 is a heel 18 which is narrower than the remainder of the scoop. The thickness of the walls is much greater at the heel than it is over the rest of the scoop, and, as a result, the heel is relatively inflexible. In the preferred embodiment illustrated, the scoop is widest immediately behind the tongue 16 and it becomes progressively narrower extending toward the heel. Preferably, the narrowing is quite pronounced with the heel being approximately one-third as wide as the widest part of the scoop thereby ensuring that the tool can be readily inserted into the narrowest of gutters and yet still work in gutters of normal width.

An elongate handle 20 attached to the heel 18 assists the user in inserting the tool into the gutter 14 and moving it along the gutter to remove debris. The handle is positioned above the side walls in order to keep the user's hands above the roof and gutter and thus protect them. It also preferably extends away from the scoop in order to assist in the insertion of the scoop into the gutter as will be more fully explained later.

In order to strengthen the side walls and prevent them from becoming torn in use, a small bead 22 extends along their upper edges.

Figure 4:
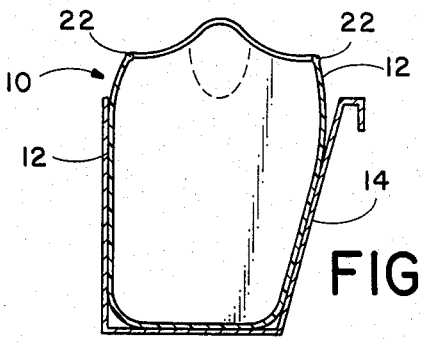
FIG. 4 is a sectional view, similar to FIG. 3, showing the tool when it is inserted into a gutter.
Figure 5:
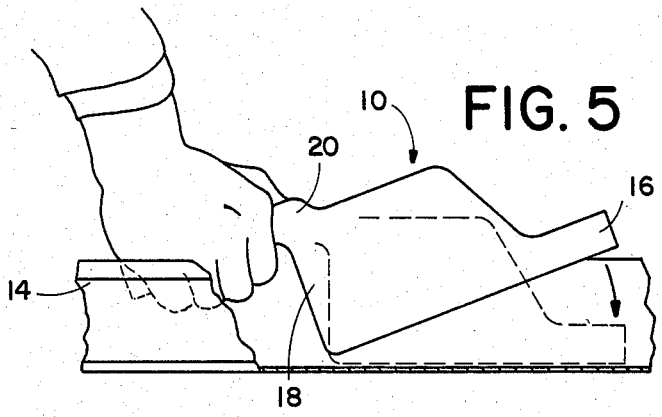
FIG. 5. is a side elevational view, partially broken away, of a gutter with a partially inserted tool shown in solid line, and a fully inserted tool shown in broken line.

Referring to FIG. 5, the tool is used by inserting the heel 18 into the gutter 14 with the front of the scoop 10 being rotated upwardly so that the tongue 16 remains above the gutter. Since the heel is quite narrow it can be inserted into almost any sized gutter, and since it is inflexible it can be forced into the gutter even if it is full of debris. The remainder of the scoop is inserted into the gutter by rotating the tongue downwardly, as shown by the arrow in FIG. 5, to the dashed-line position where the bottom of the scoop is in contact with the bottom of the gutter. When the scoop is in the gutter the side walls 12 of the scoop completely fill the gutter as shown in FIG. 4, since the mouth of the scoop, immediately behind the tongue 16, is wider than the gutter. The large taper provided in the side walls and their wide separation at the mouth ensures that the mouth of the scoop will completely fill the gutter and will even cause the side walls to spread out beyond their static width if necessary. The scoop portion of the tool is sufficiently flexible that, as the handle is rotated downwardly the mouth flattens or spreads to fill the gutter. In addition, the thickness of the flexible material of which the tool if formed is greater at the heel portion 18 than at the mouth and tongue 16 of the scoop, preferably in a tapered configuration, so that the former is more rigid and of greater strength while the side walls and leading edge of the tool are fairly flexible, as desired. The amount of the taper is necessarily small and thus is not apparent in FIG. 1 of the drawings which shows the thickness of the side walls.

Debris is removed by sliding the tool along the gutter until it is full or until a spike is encountered. The scoop is then removed and its content emptied and it is again reinserted into the gutter. It will be noted that the side walls 12 extend above the gutter thereby causing the remainder of the side walls to remain in contact with the walls of the gutter even when the gutter is completely full of debris. Also, since the handle is located above the scoop, the user's hands will not come into contact with the roof of the gutter and become injured.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A tool for removing debris from a rain gutter having a generally U-shaped cavity, said tool comprising:

(a) a U-shaped scoop having open and closed ends and an integral bottom and side walls, said side walls being easily deflected sufficiently to permit a scoop having a larger transverse dimension than a particular gutter cavity to be inserted into the gutter cavity and conform to the shape of the gutter cavity when inserted therein;

(b) a heel located at the closed end of said scoop which is narrower than the remainder of said scoop and which is relatively inflexible; and (c) handle means for inserting said heel into a gutter and for thereafter rotating the tool to conformingly insert said scoop into said gutter.

2. The tool of claim 1 wherein the side walls are shorter proximate the open end of said scoop than they are over the remainder thereof to provide a low-walled tongue at the front of said scoop.

3. The tool of claim 2 wherein the separation of said side walls is the greatest immediately inwardly of said tongue and progressively decreases moving toward said heel.

4. The tool of claim 3 wherein the thickness of said side walls progressively decreases, proceeding from the handle means to the tongue thereof, and the scoop is sufficiently flexible that said scoop will widen out in shape as pressure is applied through said handle means with the tool positioned inside said gutter, thereby filling said gutter.

5. The tool of claim 1 wherein said scoop has a U-shaped cross-section.

6. The tool of claim 1 wherein said handle means comprises an elongate handle which is attached to said heel above the top of said side walls and which extends therefrom in the opposite direction of said scoop.

7. A tool for cleaning gutters comprising:

(a) a scoop having flexible side walls which can easily be deflected to conform to the shape of the gutter when said scoop is inserted therein, said side walls being shorter proximate the open end of said scoop than they are over the remainder thereof to provide a low-walled tongue at the front of said scoop;

(b) a heel located at the closed end of said scoop which is narrower than the remainder of said scoop and which is relatively inflexible;

(c) wherein the separation of said side walls is greatest immediately inwardly of said tongue and progressively decreases moving towards said heel;

(d) handle means for inserting said heel into a gutter and for thereafter rotating the tool to conformingly insert said scoop into said gutter; and (e) wherein the thickness of said side walls progressively decreases, proceeding from said heel to the said tongue, and said scoop is sufficiently flexible that it will widen out in shape as pressure is applied through said handle means with the tool positioned inside said gutter, thereby filling said gutter.

* * * * *